US010415821B2

(12) United States Patent
Jensen

(10) Patent No.: US 10,415,821 B2
(45) Date of Patent: Sep. 17, 2019

(54) BURNER

(75) Inventor: Erling Jensen, Lem St. (DK)

(73) Assignee: Linka Maskinfabrik A/S, Lem St. (DK)

( * ) Notice: Subject to any disclaimer, the term of this patent is extended or adjusted under 35 U.S.C. 154(b) by 583 days.

(21) Appl. No.: 13/989,477

(22) PCT Filed: Nov. 23, 2011

(86) PCT No.: PCT/IB2011/055261

§ 371 (c)(1),
(2), (4) Date: Jul. 9, 2013

(87) PCT Pub. No.: WO2012/073157

PCT Pub. Date: Jun. 7, 2012

(65) Prior Publication Data

US 2013/0276681 A1 Oct. 24, 2013

(30) Foreign Application Priority Data

Nov. 29, 2010 (EP) ..... 10192968

(51) Int. Cl.
*F23B 40/06* (2006.01)
*F23L 1/02* (2006.01)
*F23L 9/02* (2006.01)

(52) U.S. Cl.
CPC ..... *F23B 40/06* (2013.01); *F23L 1/02* (2013.01); *F23L 9/02* (2013.01)

(58) Field of Classification Search
CPC ..... F23L 9/02; F23L 1/02; F23B 40/06; F23B 40/08
See application file for complete search history.

(56) References Cited

U.S. PATENT DOCUMENTS 1,689,667 A * 10/1928 Free ..... F23N 5/206 431/242
3,680,999 A * 8/1972 Hill ..... F23D 14/38 239/416.4

(Continued)

FOREIGN PATENT DOCUMENTS

FR 709915 A * 8/1931 ..... F23L 9/02
FR 2 570 472 3/1986

(Continued)

OTHER PUBLICATIONS

FR 2586086. Partial English Machine Translation. Accessed Jun. 2018.*

(Continued)

*Primary Examiner* — Jiangying C Atkisson
*Assistant Examiner* — Tavia Sullens
(74) *Attorney, Agent, or Firm* — Dinsmore & Shohl LLP

(57) ABSTRACT

The invention pertains to a burner for solid fuel, said burner comprising: A stoker (41) having a fuel outlet (29) within said burner, and an exhaust (31), a grate (27) positioned below said fuel outlet (29) and between said fuel outlet (29) and said exhaust (31), a first blower (92) connected to a space below said grate (27), and a second blower (68) connected to a plurality of injectors (61A, 62A) provided around said fuel outlet (29) above said grate (27) and directed towards said exhaust (31), said injectors (61A, 62A) being parallel and unidirectionally directed over said grate (27), and wherein the injectors (61A, 62A) are provided along the periphery of said burner, said injectors (61A, 62A) being configured for injecting secondary air at a speed of 40-80 m/s, thereby ensuring unidirectional parallel flows of secondary air over said grate (27).

9 Claims, 5 Drawing Sheets

(56) References Cited

U.S. PATENT DOCUMENTS

| | | | | | |
|---|---|---|---|---|---|
| 4,162,686 | A * | 7/1979 | Infield | F23B 5/00 | 110/260 |
| 4,515,088 | A | 5/1985 | Orjala | | |
| 4,697,530 | A | 10/1987 | Marcotte et al. | | |
| 4,876,972 | A * | 10/1989 | Mrklas | F23L 1/02 | 110/298 |
| 4,917,026 | A * | 4/1990 | Greenough | F23L 9/02 | 110/348 |
| 7,438,024 | B2 * | 10/2008 | Bast | F23L 9/02 | 122/16.1 |
| 2007/0089733 | A1 | 4/2007 | Bast | | |
| 2009/0235851 | A1 * | 9/2009 | Krebs | F23B 30/10 | 110/347 |

FOREIGN PATENT DOCUMENTS

| | | | | |
|---|---|---|---|---|
| FR | 2586086 A1 * | 2/1987 | F23L 9/02 | |
| GB | 2082302 A * | 3/1982 | F22B 31/00 | |
| GB | 2 193 798 | 2/1988 | | |
| WO | WO 00/75563 | 12/2000 | | |
| WO | WO 02/079693 | 10/2002 | | |

OTHER PUBLICATIONS

Partial English Machine Translation FR-709915. Accessed Jan. 2019.*

International Search Report for PCT/IB2011/055261 dated Jan. 12, 2012.

Written Opinion of the International Searching Authority for PCT/IB2011/055261 dated Jan. 12, 2012.

Written Opinion of the International Preliminary Examining Authority for PCT/IB2011/055261 dated Jan. 23, 2013.

International Preliminary Report on Patentability for PCT/IB2011/055261 dated Jun. 3, 2013.

* cited by examiner

BURNER

FIELD OF THE INVENTION

The present invention relates to a burner for burning solid fuel, in particular a burner where primary and secondary air is supplied to the fire.

BACKGROUND OF THE INVENTION

In a burner of this type the solid fuel is typically combusted on a grate where it is deposited by a fuel feeding mechanism, such as for example a screw conveyor including a screw disposed in a metal tube at one end connected to a silo or similar storage of solid fuel, the other end being positioned within the burner above the grate.

The grate is typically a stepped grate including a number of staggered grates which may be movable in relation to each other in order to displace ashes and other residual combustion products towards the bottom of the burner, from where they can be removed by an ash removal mechanism similar to the fuel feeding mechanism.

Air is supplied to the burner as primary air, i.e. air supplied to a space below the grate, wherefrom it passes upwardly through the grate and provides oxygen to the combustion process, and as secondary air, i.e. air which is provided to the space above the grate to provide further oxygen to the combustion of the fuel and any further combustion taking place in the flue gas produced by the combustion process. The primary and secondary air is typically supplied by electrical blowers.

In many cases the burner is combined with a boiler, whereby the flue gas resulting from the combustion process is led through flue gas pipes deposited in a boiler, where the heat of the flue gas is used to heat water circulating through the boiler. The cooled flue gas may then be released into the atmosphere via a chimney, possibly after further cleaning of the flue gas.

Typically, secondary air is supplied from two opposite directions, whereby the collision of the air streams forces part of the secondary air down through the grate, which hampers the flow of the primary air, thus affecting the oxygen dependent combustion negatively.

A burner where the secondary air is not supplied from two opposite directions is known from amongst others WO8301671; however, this burner supplies the secondary air as a horizontal rotational flow. Thus, the secondary air may still interfere with the primary air.

Other examples of burners can be seen in for example U.S. Pat. No. 4,697,530, which discloses an automatic stoker boiler having air openings in an air plenum, which are placed in the opposite side of the stoker as the fuel inlet. Especially the air openings are not placed around the fuel outlet, and WO 02/079693 discloses a burner with a fuel outlet and a grate positioned below said outlet. The burner is equipped with a number of air holes in all the sides for the supply of secondary air, for cooling the sides and cover part. By the disclosed arrangement of air holes in all sides of the burner it is not possible to sustain unidirectional parallel flow of air over the grate.

US 2007/089733 discloses a wood-burning boiler having a fire chamber and a loading door for fuel supply. The boiler also comprises a grate, under which under fire air is supplied for sustaining the combustion of the fuel. In the rear plate there is provided a plurality of air holes for the supply of secondary over-fire air into the fire chamber. The disclosed arrangement of air holes is therefore not capable of sustaining a unidirectional parallel flow of air over the grate.

GB 2 193 798 discloses a cylindrical coal burner equipped with a stepped grate, wherein each grate section is equipped with a plurality of venture ports, which are disposed in the side of the cylindrical wall of the burner, and at an angle of approximately 60 degrees relative to the longitudinal portion of the burner. In the end wall there is provided a plurality of air ports for the inlet of air in a direction substantially along the longitudinal extension of the burner. These air ports are not placed above the fuel outlet, and the combined effect of these air ports is to impart a circulatory motion to the coals.

FR 2 570 472 discloses a cylindrical coal stoker having a fuel outlet and an exhaust, a grate positioned below said outlet and between said fuel outlet and said exhaust. FR 2 570 472 also discloses means for supplying primary air through said grate for the combustion of coal, and means for supplying secondary air from a plenum above said fuel outlet.

WO 00/75563 discloses a burner for the burning of solid fuels. The burner comprises a fuel outlet and an exhaust, a cartridge with longitudinal apertures for the provision of under-fire air to enhance the combustion of the fuel. Furthermore, adjacent to the fuel outlet there are placed two tube pieces for the provision of air along the longitudinal direction of the burner. Additionally, there are provided air holes in the bottom of the burner for the provision of tertiary air into the combustion chamber in order to create turbulence within the combustion chamber. Moreover the tube pieces are placed so far apart from each other that they will not be able to sustain a unidirectional parallel flow of secondary air over the grate.

SUMMARY OF THE INVENTION

It is a primary object of the present invention to provide a more efficient combustion of solid fuel as compared to the types of burners known in the art.

This and further objects are achieved by a burner for solid fuel, said burner comprising: a stoker having a fuel outlet within said burner, and an exhaust, a grate positioned below said fuel outlet and between said fuel outlet and said exhaust, a first blower connected to a space below said grate, and a second blower connected to a plurality of injectors provided around said fuel outlet above said grate and directed towards said exhaust, said injectors being parallel and unidirectionally directed over said grate, wherein the injectors are provided along the periphery of said burner, said injectors being configured for injecting secondary air at a speed of 40-80 m/s, thereby ensuring unidirectional parallel flows of secondary air over said grate.

By placing the air injectors along the periphery of said burner and injecting the secondary air at a speed of 40-80 m/s, it is possible to achieve the effect of ensuring a substantially laminar flow of secondary air over the entire length of the grate, because the secondary air will travel in a laminar flow along the upper periphery of the burner at a sufficient speed to ensure this laminar or substantially laminar flow. This laminar air flow creates a pressure difference between the upper and lower part of the combustion chamber, whereby flue gas from the combustion of the solid fuel is drawn away from the grate. This causes a more efficient combustion, because the secondary air will not collide with the primary airstreams from beneath the grate and therefore not adversely influence the flow of air and thereby oxygen necessary for the combustion of the solid fuel. In fact, the above mentioned pressure difference will enhance the flow of primary air necessary for the combustion.

According to an embodiment of the invention, there is thus provided a burner where secondary air does not interfere with primary air.

One embodiment of the invention pertains to a burner for solid fuel, said burner comprising a grate, a first blower connected to a space below said grate, and a second blower connected to a plurality of injectors provided above said grate, wherein said injectors are parallel and unidirectionally directed over said grate.

Since the injectors are parallel and unidirectionally directed over the grate, the air supplied by the second blower to the injectors is supplied as parallel flows of air over the grate. As the flows are parallel, no collision which could force the secondary air down towards the grate or through the grate where the secondary air could disturb the flow of primary air occurs. Furthermore, the parallel flows of secondary air over the grate cause an ejector effect, whereby the flue gas from the combustion of the solid fuel is drawn away from the solid fuel and the grate, thus facilitating the provision of oxygen, by the primary air to the solid fuel being combusted.

The burner may comprise a cylindrical enclosure in which the grate is positioned. The cylinder is preferably circular cylindrical and preferably oriented so that the axis of the cylinder is substantially horizontal. The burner and the grate may be made from metal, preferably steel or iron.

The solid fuel may be any readily combustible solid fuel such as coal, peat, lignite, but is preferably a solid renewable bio fuel such as straw, wood chips or wood pellets. It is further contemplated within the context of the present invention that slurries, i.e. solids in liquid, could be combusted in the burner.

The grate supports the solid fuel during the combustion thereof while also allowing air from below the grate to pass through the grate to supply the combustion process with fuel. The air may pass between the bars and crossbars of the grate, or alternatively the grate may be defined as a plate with apertures such as holes or slits through which the air may pass.

The grate is preferably a stepped grate comprising a plurality of staggered grates adapted to be movable in relation to each other for transporting the solid fuel by gravity from the top grate to the bottom grate, where the ashes and other solid residual products from the combustion process may be removed.

The space is provided below the grate and is bounded by the grate and the walls and floor of the burner so that upon introduction of air into the space, the air may escape the space through the grate.

The first and second blowers may be centrifugal, axial, or alternatively cross flow fans which may be driven by an electric or alternatively by an internal combustion motor. The fans are preferably provided outside the burner where the first blower is preferably connected to the space below the grate by a first duct, and the second blower is preferably connected to the injectors by a second duct.

Blowers may be used in tandem where the output of one blower is not enough for delivering the air volume required by the combustion process, the air volume required being dependent on the amount of fuel combusting on the grate.

In the context of the present invention, the term "parallel" is to be understood as extending or pointing, or being oriented in the same direction. In the context of the present invention, the term "unidirectionally" is to be understood as in one direction only. In the context of the present invention, the term "above" is to be understood as a position above a horizontal plane. In the context of the present invention, the term "over" is to be understood as a position perpendicularly above a bounded surface of a horizontal plane.

Another embodiment of the present invention pertains to a burner as described above, said burner further comprising a stoker having a fuel outlet within said burner, and an exhaust, wherein said grate is positioned below said fuel outlet and between said fuel outlet and said exhaust, and wherein said injectors are provided around said fuel outlet above said grate and directed towards said exhaust. By positioning the grate below the stoker, the solid fuel is easily deposited on the grate. By positioning the injectors around the fuel outlet, the injectors do not intrude on the space needed for the grate and the combustion process. Moreover, the injectors may help cool the fuel outlet. By providing the burner with an exhaust, and directing the injectors towards the exhaust, the secondary air, injected by the injectors, draws flue gas from the grate and the combusting solid fuel towards the exhaust.

Preferably said injectors are placed along the periphery of the burner, whereby the flows of secondary air cool the periphery of the burner and prevent ash and other combustion residual products from settling or adhering to the walls.

In a preferred embodiment the stoker comprises a screw conveyor disposed within a tube, said fuel outlet being defined by one end of said tube, whereby the feeding of particulate as well as granulate, fibrous, pelletized and slurried, i.e. solids in a liquid, fuel is possible.

Preferably, said exhaust is connected to a plurality of horizontal flue gas pipes extending through a boiler, whereby the heat from the solid fuel is harnessed by a boiler, where it can be used to heat a fluid for example for residential heating or for providing steam to an industrial process. The flue pipes and the boiler are preferably made from metal such as steel.

According to an embodiment the above mentioned injectors each comprise a tube having a first inner diameter at a first end and a second inner diameter at a second, said second inner diameter being less than said first inner diameter, and a stepped transition from said first inner diameter to said second inner diameter being provided in said tube between said first end and said second end, whereby a simple, cheap and reliable injector is provided, which is easy to clean. The tubes are preferably assembled by welding. The injector could however also be fabricated from a single piece by milling.

Alternatively, the above mentioned injectors may each comprise a plurality of coaxial tubes provided on within the other each pair of adjacent tubes defining a space between said tubes, thus, yielding an alternative injector causing less turbulence in the burner.

The above mentioned and further objects are also achieved by a method of combusting solid fuel burning on a grate in a burner comprising the steps of: supplying primary air through said grate from below said grate, and supplying secondary air as a plurality of unidirectional parallel flows above said grate, and along the periphery of said burner, towards an exhaust provided in said burner, wherein said secondary air is injected into the burner at a speed of 40-80 m/s, thereby ensuring a parallel flow of air over said grate and hence that flue gas from said combustion of said fuel is drawn off by said parallel flows of secondary air.

In a second aspect of the present invention a method of combusting solid fuel is I burning on a grate in a burner is provided, the method comprising the steps of: supplying primary air through said grate from below said grate, and supplying secondary air above said grate, wherein said secondary air is supplied as a plurality of unidirectional parallel flows over said grate, whereby flue gas from said combustion of said fuel is drawn off by said parallel flows of secondary air.

According to an embodiment of any of the above mentioned methods, a step of heating a fluid by heat exchange with said flue gas may be included in said methods, whereby the heat from the flue gas is transferred to a fluid which can be used for residential heating or to provide steam, while the flue gas is cooled for being safely emitted to the atmosphere.

According to an embodiment of any of the above mentioned methods, a step of feeding solid fuel to said grate and removing residual combustion products from said burner may be included in any of said methods, whereby a continuous method of combusting solid material with a high combustion efficiency is provided.

BRIEF DESCRIPTION OF THE DRAWINGS

The invention and its many advantages will be described in more detail below with reference to the accompanying schematic drawings, which for the purpose of illustration show some non-limiting embodiments, and in which.

DETAILED DESCRIPTION

Figure 1A:
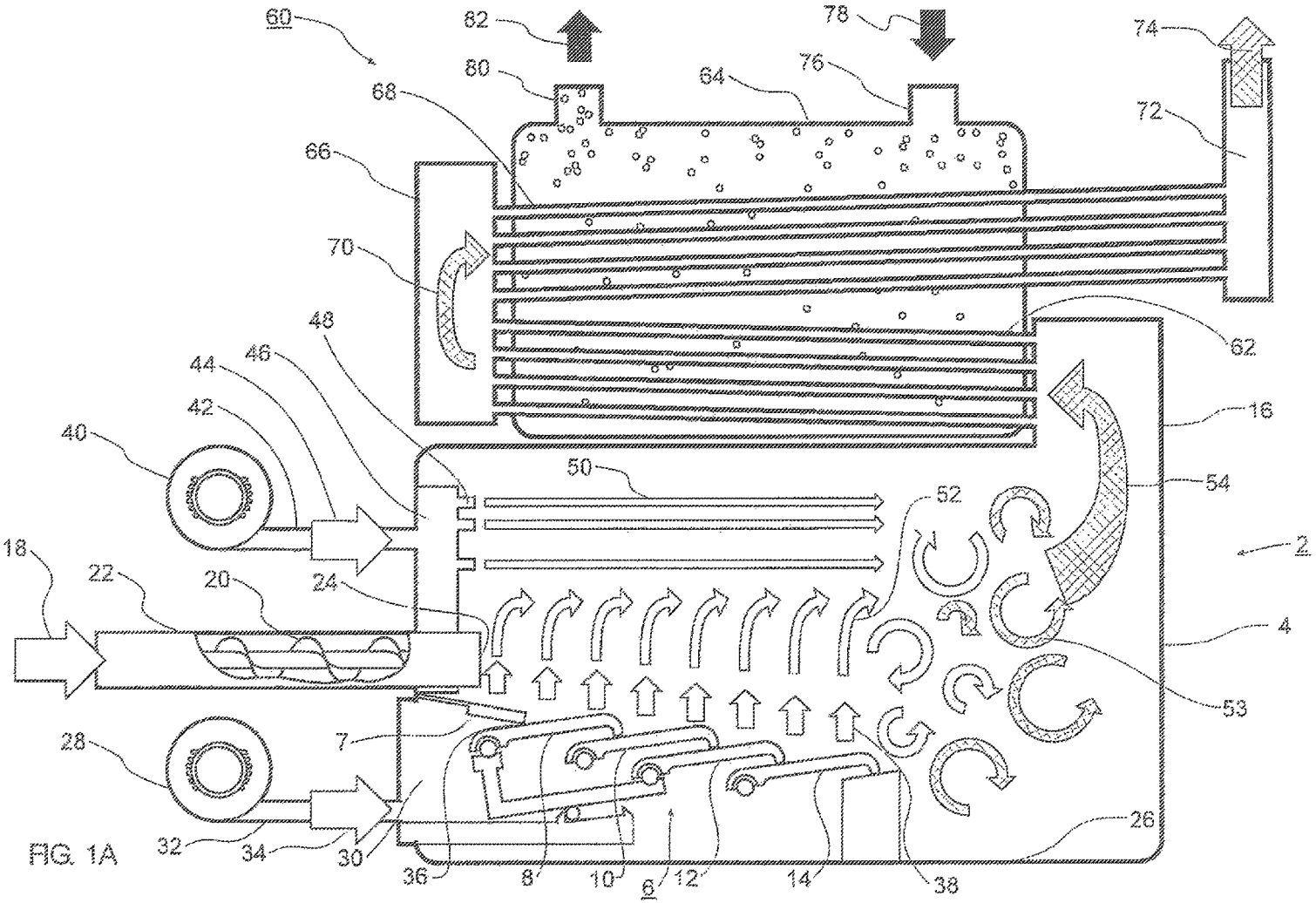
FIG. 1A shows a burner according to the first aspect of the present invention, the burner being connected to a boiler.

The present invention will now be described more fully hereinafter with reference to the accompanying drawings, in which exemplary embodiments of the invention are shown. The invention may however be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will thus not be described in detail with respect to the description of each figure.

FIG. 1A shows a burner, in its whole designated the reference numeral 2, according to the first aspect of the present invention. The burner 2 comprises a gas tight cylindrical enclosure, designated the reference numeral 4, made of welded steel and having a stepped grate, in its whole designated the reference numeral 6, having a feed plate, designated the reference numeral 7, and having four descending grates, designated the reference numerals 8, 10, 12 and 14, at one end, and an exhaust, designated the reference numeral 16, at the other end. Fuel is fed to the burner, as indicated by the arrow designated the reference numeral 18, by a screw conveyor comprising a screw, designated the reference numeral 20, provided within a tube, designated the reference numeral 22, which extends through the enclosure 4 and has a fuel outlet, designated the reference numeral 24, above the grate 8, onto which solid fuel is deposited after being conveyed by the screw 20 through the tube 22. By a horizontal reciprocating movement of the grates 8 and 12, the solid fuel is eventually transported to the bottom, designated the reference numeral 26, of the enclosure 4, while being combusted and transformed into ash and combustion residual products, from which the ashes and the residual products are removed by a second screw conveyor (not shown) perpendicular to the screw conveyor defined by screw 20 and tube 22.

Primary air is supplied by a first electric blower, designated the reference numeral 28, which supplies primary air to a space, designated the reference numeral 30, below the stepped grate 6, through a primary air duct, designated the reference numeral 32, as indicated by the arrow designated the reference numeral 34, from which the primary air is led through holes, one of which is designated the reference numeral 36, in the grates 8, 10, 12 and 14, for supplying the primary air to solid fuel (not shown) burning on the stepped grate 6, as shown by arrows, one of which is designated the reference numeral 38.

A second electric blower, designated the reference numeral 40, supplies secondary air at a rate of 1200 $m^3/h$ through a secondary air duct, designated the reference numeral 42, as indicated by the arrow designated the reference numeral 44, to an air rail, designated the reference numeral 46, from which the secondary air is led to injectors, one of which is designated the reference numeral 48, wherefrom the secondary air is injected as parallel unidirectional air flows, one of which is designated the reference numeral 50, over the stepped grate 6 and directed towards the exhaust 16.

The high speed, typically 55-65 m/s, of the air flows 50 gives rise to an ejector effect, whereby flue gases, as indicated by the curved arrows, one of which is designated the reference numeral 52, emanating from above the stepped grate 6 from the solid fuel combusting on the stepped grate 6 are drawn away from the stepped grate 6 and entrained by the air flows 50 and moved towards the exhaust 16.

After passing the grate 6, the mixture of flue gasses 52 and air flows 50 becomes turbulent and forms whirls, as is shown by the arrow designated the reference numeral 53, before being sucked up towards the exhaust 16.

FIG. 1 also shows a boiler, in its whole designated the reference numeral 60, provided above the burner 2, said boiler comprising a first set of substantially horizontal flue gas pipes, one of which is designated the reference numeral 62, which are connected to the exhaust 16 of the burner 2, whereby the mixture of flue gases 52 and the primary and secondary air 38 and 50 is led into the first set of flue gas pipes 62, as indicated by the arrow designated the reference numeral 54.

The boiler includes a boiler tank, designated the reference numeral 64, through which the first set of flue gas pipes 62 extends. A coupling space, designated the reference numeral 66, is provided where the mixture of flue gas and primary and secondary air exits the first set of flue gas pipes 62. A second set of substantially parallel flue gas pipes, one of which is designated the reference numeral 68, is connected to the coupling space 66, and the mixture of flue gas and primary and secondary air is routed into the second set of flue gas pipes 68 as shown by the arrow designated the reference numeral 70. The second set of flue gas pipes 68 extends once more through the boiler tank 64 before connecting to a chimney, designated the reference numeral 72, allowing the mixture of flue gas and primary and secondary air to be released into the atmosphere as indicated by the arrow designated the reference numeral 74.

Water to be heated in the boiler 60 is admitted into the boiler tank 64 at an inlet, designated the reference numeral 76, as shown by the arrow designated the reference numeral 78, while heated water is withdrawn from the boiler tank at an outlet, designated the reference numeral 80, as shown by the arrow designated the reference numeral 82.

The burner 2 and the boiler 60 are insulated from the surroundings by 100 mm mineral wool (not shown).

Figure 1B:
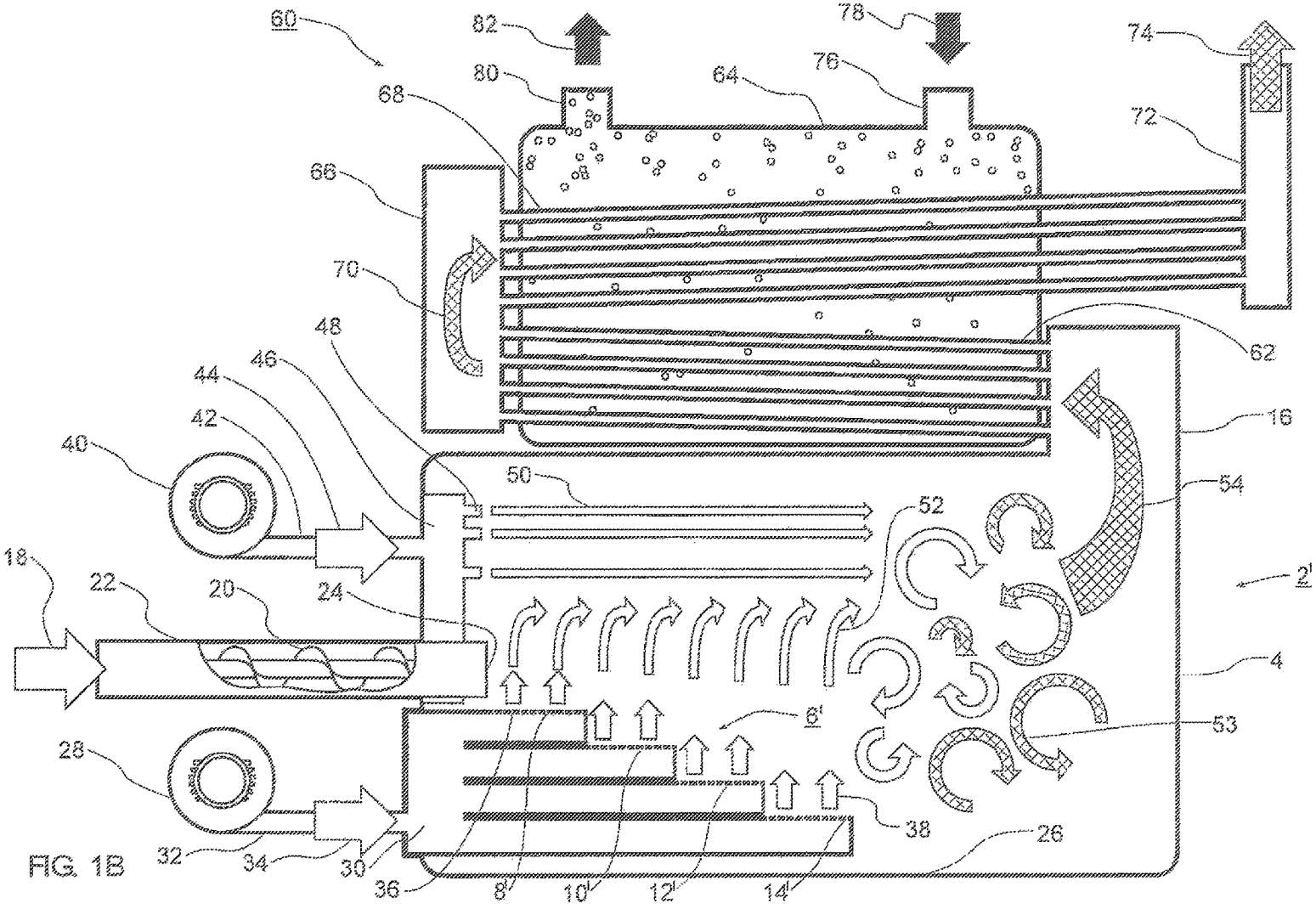
FIG. 1B shows an alternative embodiment of a burner according to the first aspect of the present invention, the burner being connected to a boiler.

FIG. 1B shows an alternative embodiment of the burner according to the first aspect of the present invention, wherein features identical with those of FIG. 1A are referenced by the same reference numerals, and wherein features having the same purpose or function but differing in construction are referenced by the same reference numeral, with a superscript roman numeral, as those of FIG. 1A.

Figure 2A:
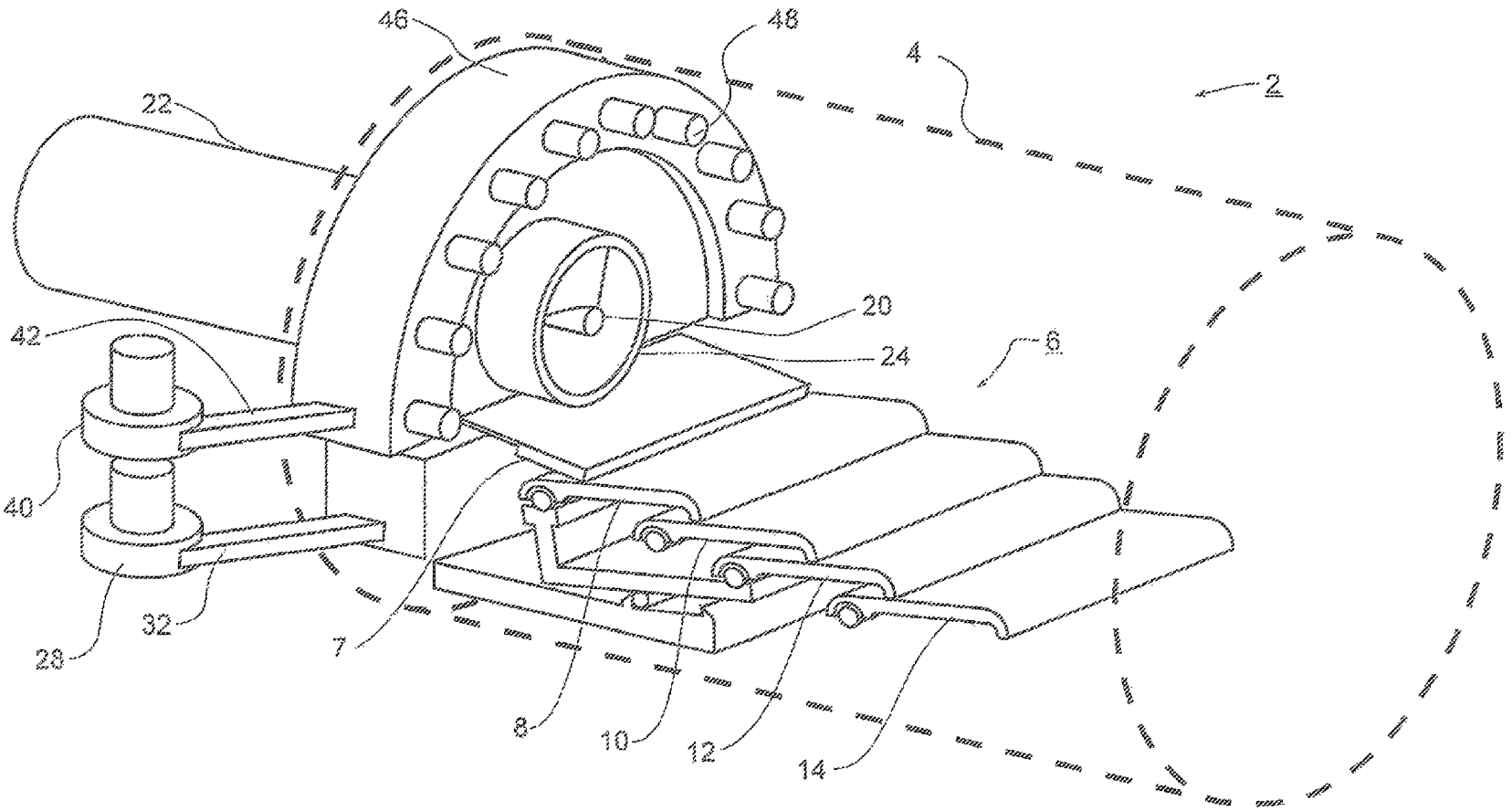
FIG. 2A shows a view of the injector arrangement in the burner according to the first aspect of the present invention.

FIG. 2A shows a view of the injector arrangement in the burner 2 according to the first aspect of the present invention. The air rail 46 is shaped as an inverted U and surrounds the fuel outlet 24 which is placed above the stepped grate 6. The injectors 48 are provided on the air rail 46 along the periphery of the enclosure 4. The second electric blower 40 supplies secondary air to the air rail 46 through the secondary air duct 42, while the first electric blower 28 supplies primary air through the primary air duct 32 to the space 30 (not shown in FIG. 2) below the stepped grate 6.

Figure 2B:
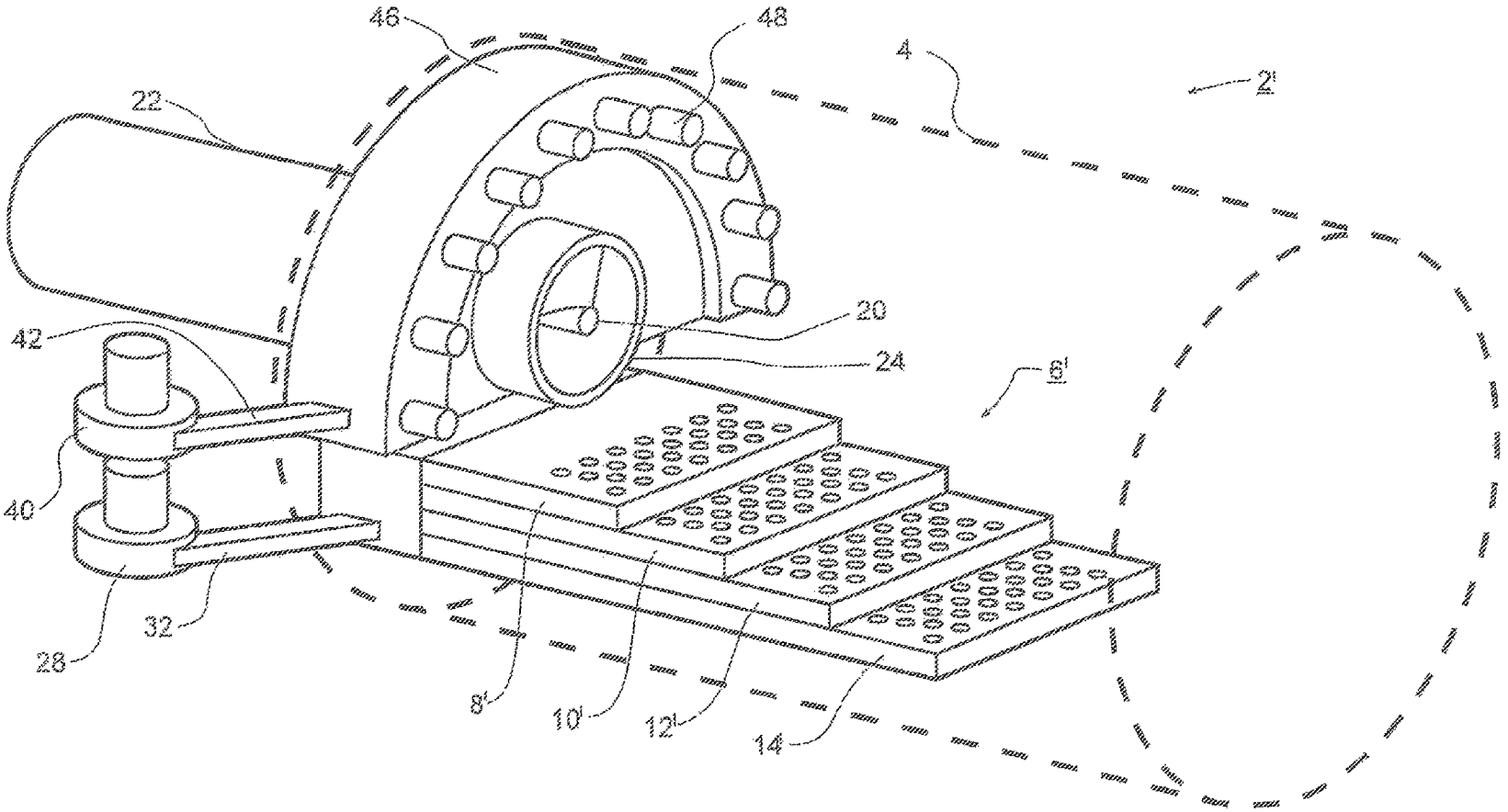
FIG. 2B shows a view of the injector arrangement in an alternative embodiment of the burner according to the first aspect of the present invention.

FIG. 2B shows a view of the injector arrangement in alternative embodiment of the burner 2' according to the first aspect of the present invention, wherein features identical with those of FIG. 2A are referenced by the same reference numerals, and wherein features having the same purpose or function but differing in construction are referenced by the same reference numeral, with a superscript roman numeral, as those of FIG. 2A.

Figure 3A:
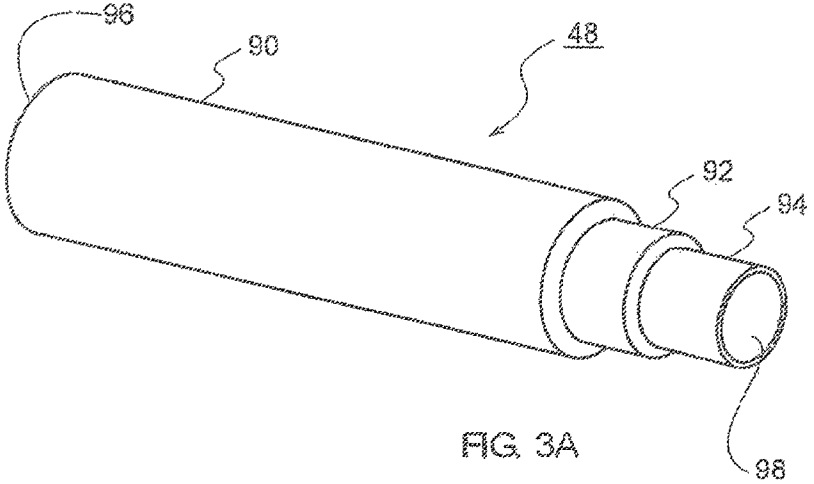
FIG. 3 shows a an injector for use in the burner according to the first aspect of the present invention as shown in FIGS. 1-2, and, FIG. 4 shows an alternative embodiment of an injector for use in the burner according to the first aspect of the present invention as shown in FIGS. 1-2.
Figure 3B:
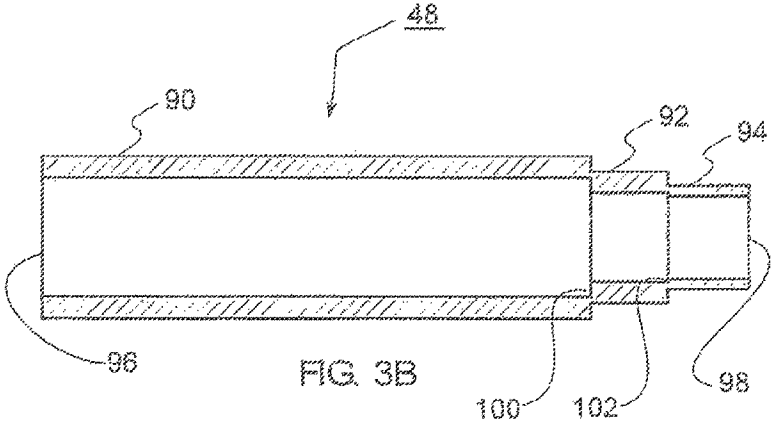

FIGS. 3A and 3B, where 3A is a perspective view, and 3B is a section view, show a first embodiment of the injector 48 for use in the burner 2 according to the first aspect of the present invention as shown in FIGS. 1-2. The injector 48 comprises three metal tubes, designated the reference numerals 90, 92, and 94, respectively, of different diameters, which are welded together end-to-end to form the injector 48, having a first end, designated the reference numeral 96, having a large inner diameter for being mounted to the air rail 46 for receiving secondary air from the air rail 46, and a second end, designated the reference numeral 98, having a small inner diameter for injecting a flow of secondary air 50 into the burner 2. The transition from the large inner diameter of the tube 90 at the first end 96 to the smaller inner diameter of the tube 94 at the second end is achieved by first and second restrictions, designated the reference numerals 100 and 102, respectively, which are formed where the tubes 90 and 92 join, and where the tubes 92 and 94 join, respectively. Secondary air passing through the injector 48 accelerates due to the difference in inner diameter, i.e. cross sectional area, between the first end 96 and the second end 98. The inner diameter of the second end 98 is 27 mm, which, depending on the number of injectors, typically 9-10, and the airflow established by the second electric blower 40, typically 1200 $m^3/h$, results in an initial, i.e. as the air leaves the second end 98 of the injector 48, air speed of 55-65 m/s.

In FIG. 3B, the tubes 90 and 92 are shown as having the same wall thickness, while the tube 94 has a thinner wall thickness, which is the preferred embodiment since it simplifies the welding together of the tubes 92 and 94. The tubes 90, 92 and 94 may however also have the same wall thickness.

Figure 4A:
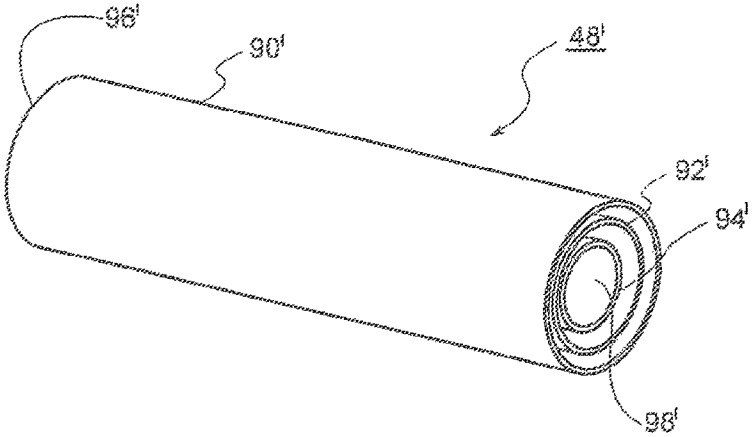
Figure 4B:
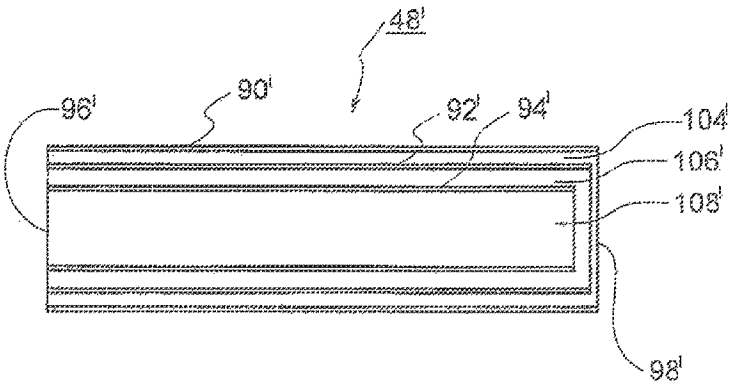

FIGS. 4A and 4B, where 4A is a perspective view, and 4B is a section view, show an alternative embodiment of an injector, designated the reference numeral $\mathbf{48}^I$, for use in the burner 2 according to the first aspect of the present invention as shown in FIGS. 1-2. The injector $\mathbf{48}^I$ comprises three metal tubes, designated the reference numerals $\mathbf{90}^I$, $\mathbf{92}^I$, and $\mathbf{94}^I$, respectively, of different diameters, which are placed one-inside-theother, forming the injector $\mathbf{48}^I$ having a first end, designated the reference numeral $\mathbf{96}^I$, for receiving secondary air from the air rail 46, and a second end, designated the reference numeral $\mathbf{98}^I$, for injecting a flow of secondary air 50 into the burner 2. Secondary air is led from the first end $\mathbf{96}^I$ to the second end $\mathbf{98}^I$ in the annular spaces, designated the reference numerals $\mathbf{104}^I$ and $\mathbf{106}^I$, defined by the tubes $\mathbf{90}^I$ and $\mathbf{92}^I$ and the tubes $\mathbf{92}^I$ and $\mathbf{94}^I$, respectively, and the circular space, designated the reference numeral $\mathbf{108}^I$, defined by the tube $\mathbf{94}^I$, The tubes $\mathbf{90}^I$, $\mathbf{92}^I$ and $\mathbf{94}^I$ are preferably fastened together at the first end $\mathbf{96}^I$ by radially and angularly spaced struts (not shown) between the respective tubes $\mathbf{90}^I$ and $\mathbf{92}^I$, and $\mathbf{92}^I$ and $\mathbf{94}^I$.

By leading the secondary air through the spaces $\mathbf{104}^I$, $\mathbf{106}^I$ and $\mathbf{108}^I$, the turbulence in the burner may be lessened. Further, by varying the sizes of the spaces $\mathbf{104}^I$, $\mathbf{106}^I$ and $\mathbf{108}^I$, the injector $\mathbf{48}^I$ allows different flow profiles for the flows of secondary air.

EXAMPLE

Tests with a burner and boiler as described in FIGS. 1-2 with injectors as described in FIG. 3 have shown that more than 93% of the theoretical energy content of the solid fuel were converted to heat.

List of parts with reference to the figures:

2. Burner
2'. Burner (alternative embodiment)
4. Enclosure
6. Stepped grate
6'. Stepped grate (alternative embodiment)
7. Feed plate
8. Grate
8'. Grate (alternative embodiment)
10. Grate
10'. Grate (alternative embodiment)
12. Grate
12'. Grate (alternative embodiment)
14. Grate
14'. Grate (alternative embodiment)
16. Exhaust
18. Arrow indicating feeding of fuel
20. Screw
22. Tube
24. Fuel outlet
26. Bottom
28. First electric blower
30. Space
32. Primary air duct
34. Arrow indicating primary air
36. Hole
38. Arrow indicating primary air
40. Second electric blower
42. Secondary air duct
44. Arrow indicating secondary air
46. Air rail
48. Injector
48'. Injector (second embodiment
50. Air flow -continued

| List of parts with reference to the figures: |
|---|
| 52. Arrow indicating flue gas |
| 53. Arrow indicating turbulence |
| 54. Arrow indicating mixture of flue gas and primary and secondary air |
| 60. Boiler |
| 62. First set of flue gas pipes |
| 64. Boiler tank |
| 66. Coupling space |
| 68. Second set of flue gas pipes |
| 70. Arrow indicating mixture of flue gas and primary and secondary air |
| 72. Chimney |
| 74. Arrow indicating mixture of flue gas and primary and secondary air |
| 76. Inlet |
| 78. Arrow indicating water flow in |
| 80. Outlet |
| 82. Arrow indicating water flow out |
| 90. Tube |
| 90'. Tube (alternative embodiment) |
| 92. Tube |
| 92'. Tube (alternative embodiment) |
| 94. Tube |
| 94'. Tube (alternative embodiment) |
| 96. First end |
| 96'. First end (alternative embodiment) |
| 98. Second end |
| 98'. Second end (alternative embodiment) |
| 100. First restriction |
| 102. Second restriction |
| 104'. Annular space |
| 106'. Annular space |
| 108'. Circular space |

The invention claimed is:

1. A burner for solid fuel comprising:

an enclosure extending longitudinally from a first end to a second end, the enclosure enclosing an interior area;

a fuel inlet positioned to feed fuel in a first direction into the first end of the enclosure of the burner;

a grate positioned in the interior area in front of the fuel inlet to receive fuel from the fuel inlet and carry such fuel in the first direction, the first direction being defined from the first end to the second end of the enclosure and substantially parallel to a longitudinal direction of the grate;

a turbulence space defined in the interior area of the enclosure downstream from the grate, in the first direction;

the enclosure having an exhaust portion communicating with the turbulence space and configured to exhaust combustion gases from the interior area, the exhaust portion being downstream from the fuel inlet and the grate in the first direction;

a first blower configured to introduce primary air into the enclosure below the grate;

a second blower and a plurality of injectors connected to the second blower, the plurality of injectors being arranged around a periphery of the fuel inlet and parallel to the first direction;

an air rail in the shape of an inverted U extending above and on sides of the fuel inlet, the plurality of injectors being evenly-spaced and mounted on the air rail such that the injectors are arranged above the grate;

the second blower configured to inject secondary air in the first direction at a predetermined speed through the plurality of injectors into the enclosure above the grate to ensure that the secondary air is injected as substantially laminar flow over the entire length of the grate and parallel to the grate, the plurality of injectors configured to ensure that the secondary air does not interfere with the primary air and gives rise to an ejector effect such that the combustion gases are drawn away from the grate into the turbulence space and entrained by the substantially laminar flow of the secondary air and moved towards the exhaust portion.

2. The burner according to claim 1, wherein the exhaust portion is at the second end of the enclosure.

3. The burner according to claim 1, wherein said exhaust portion is connected to a plurality of horizontal flue gas pipes extending through a boiler.

4. The burner according to claim 1, wherein each injector comprises a tube having a first inner diameter at a first end, and a second inner diameter at a second end, the second inner diameter being less than the first inner diameter, and a stepped transition from the first inner diameter to the second inner diameter being provided in the tube between the first end and the second end.

5. The burner according to claim 1, wherein each injector comprises a plurality of coaxial tubes, each coaxial tube having a different diameter such that the coaxial tubes each defining a space between an adjacent tube of the coaxial tubes.

6. The burner according to claim 1, wherein the predetermined speed of the secondary air is 40-80 m/s.

7. The burner according to claim 1, wherein the air rail is located along a periphery of the enclosure.

8. The burner according to claim 1, further comprising a stoker having a fuel outlet in communication with said fuel inlet.

9. The burner according to claim 8, wherein the stoker comprises a screw conveyer disposed within a tube, said fuel outlet being defined by one end of said tube.

* * * * *